US007056173B1

(12) United States Patent
Shull et al.

(10) Patent No.: US 7,056,173 B1
(45) Date of Patent: Jun. 6, 2006

(54) HEATER AND A METHOD FOR DELIVERING HEAT ENERGY FROM A WATER COOLED TWO CYCLE MARINE ENGINE

(75) Inventors: Dan Shull, Newman Lake, WA (US); Jeff Hubble, Rathdrum, ID (US)

(73) Assignee: Heater Craft Marine Products, Rathdrum, ID (US)

( * ) Notice: Subject to any disclaimer, the term of this patent is extended or adjusted under 35 U.S.C. 154(b) by 0 days.

(21) Appl. No.: 11/019,021

(22) Filed: Dec. 21, 2004

(51) Int. Cl.
*B63H 21/38* (2006.01)

(52) U.S. Cl. ..... 440/88 D; 237/12.3 R; 440/88 HE

(58) Field of Classification Search ..... 440/88 D, 440/88 G, 89 B, 89 J, 88 J, 89 C, 88 HE, 440/88 L, 88 F
See application file for complete search history.

(56) References Cited

U.S. PATENT DOCUMENTS 3,211,374 A * 10/1965 Matulaitis ..... 237/8 R
3,404,731 A * 10/1968 Cushman ..... 165/51
3,431,943 A * 3/1969 Armand ..... 137/625.31
5,429,534 A * 7/1995 Cano ..... 440/88 R
5,617,811 A * 4/1997 Johnson ..... 114/363
5,954,553 A * 9/1999 Ozawa et al. ..... 440/89 R
6,094,758 A * 8/2000 Renfro ..... 5/118

* cited by examiner

*Primary Examiner*—Sherman Basinger
(74) *Attorney, Agent, or Firm*—Wells St. John P.S.

(57) ABSTRACT

A heater and method for delivering heat energy from a water cooled two cycle marine engine is described and which includes an exhaust expansion chamber operably coupled with a two cycle marine engine, and wherein the two cycle marine engine produces a source of heated water; a heater coupled in fluid flowing relation relative to the exhaust expansion chamber, and which receives the source of heated water; and a flow restrictor coupled in fluid flowing relation relative to both the heater and the exhaust expansion chamber, and which delays the delivery of the heated water from the exhaust expansion chamber to the heater to increase the temperature of the heated water.

17 Claims, 3 Drawing Sheets

HEATER AND A METHOD FOR DELIVERING HEAT ENERGY FROM A WATER COOLED TWO CYCLE MARINE ENGINE

TECHNICAL FIELD

The present invention relates to a heater, and a method for producing heat energy during the operation of a water cooled two cycle marine engine.

BACKGROUND OF THE INVENTION

Marine engines of assorted designs including both two cycle and four cycle motors have been utilized with marine craft of various designs over the years. Still further, various drive systems have been coupled to these marine motors, including various propeller and screw arrangements. More recently, in the last several decades, water jet propulsion systems have been utilized widely in watercraft of various types and in particular in small personal watercraft having lengths frequently less then ten feet. In connection with such water jet propulsion systems, two cycle water cooled marine engines are frequently employed.

Water jet propulsion systems, have many advantages over more traditional propulsion systems on watercraft inasmuch as that boats utilizing same can often maneuver in aquatic environments where more traditional propulsion systems which have propellers, would have difficulty. For example, many larger water jet propelled boats have very shallow drafts and are often utilized to shuttle passengers, such as hunters into distance back-country wilderness areas where they may be dropped off for fishing and hunting trips. In these environments, guides may maneuver these boats in shallow rivers and streams and land, or beach the boats at various locations without fear of damaging the associated propulsion systems.

Simply put, a water jet propulsion system discharges a high velocity jet stream of water which reacts with the surrounding aquatic environment to propel the hull of the watercraft through the water. In a boat which is equipped with a water jet propulsion system, the jet unit is mounted in-board of the aft section of the boat hull. Water enters the jet unit near the bottom of the hull and is thereafter accelerated through the jet unit and out through the transom of the boat at high velocity. A prior art jet propulsion system is shown in FIGS. 1 and 2. The steering of the boat is achieved by changing the direction of the stream of water as it leaves the transom of the boat. In this regard, pointing the jet stream in one direction forces the stern of the boat in the opposite direction and causes the vessel to turn. Still further, reverse is achieved by lowering a stern deflector into the jet stream after it leaves the transom. This reverses the direction of the force generated by the jet stream forward and downward and causes the boat to be propelled in a stern direction. In order to utilize a water jet propulsion system, the marine engine must drive the jet unit at a relatively high RPM in order to impart sufficient energy to an impeller which produces the required propulsion for the watercraft. Consequently, two cycle marine motors have been found useful for these purposes.

While the propulsion systems and two cycle marine motors which have been utilized heretofore have operated with a great deal of success, there are shortcomings attendant with their designs. For example, these aforementioned two cycle marine motors which are associated with these propulsion systems are water cooled. More specifically, these two cycle marine motors withdraw water from the body of water upon which the watercraft is resting, and thereafter supplies this water to the two cycle marine motor for cooling. In view of the nature of the operation of a two cycle marine motor, the time with which this cooling water remains within the marine engine is limited. Water exiting the marine engine after cooling same frequently departs the marine engine at a temperature of about 60° F. to about 80° F. This heated water is subsequently returned to the ambient environment.

In view of this arrangement, there has been no convenient means provided heretofore where the heat energy generated by the marine motor during operation can be converted into a source of heat energy which could be imparted to a heater unit, which might radiate heat energy to the occupants of the watercraft. This is particularly desirable when boats of this design are utilized to shuttle passengers during inclement weather or at times when the ambient air temperature is extremely low.

Therefore, a heater and a method for delivering heat energy from a water cooled two cycled marine engine is the subject matter of the present application.

SUMMARY OF THE INVENTION

A first aspect of the present invention relates to a heater for a water cooled two cycle marine engine and which includes an exhaust expansion chamber operably coupled with a two cycle marine engine, and wherein the two cycle marine engine produces a source of heated water; a heater coupled in fluid flowing relation relative to the exhaust expansion chamber, and which receives the source of heated water; and a flow restrictor coupled in fluid flowing relation relative to both the heater and the exhaust expansion chamber, and which delays the delivery of the heated water from the exhaust expansion chamber to the heater to increase the temperature of the heated water.

Another aspect of the present invention relates to a heater for a water cooled two cycle marine engine, and which includes an exhaust expansion chamber which is operably coupled with a marine engine, and which receives water which has been previously heated by the operation of a marine engine; a heater for receiving the heated water which has been previously delivered to the exhaust expansion chamber, and which further radiates heat energy derived from the heated water to the ambient environment; a conduit coupling the exhaust expansion chamber and the heater in fluid flowing relation one relative to the other; and a flow restrictor mounted in fluid metering relation along the conduit and between the heater and the exhaust expansion chamber, and wherein the fluid restrictor increases the temperature of the water which has been delivered to the exhaust expansion chamber.

Still further, another aspect of the present invention relates to a heater for a water cooled two cycle marine engine, and which includes a base assembly which is coupled to a water cooled two cycle marine engine, and which facilitates the withdrawal of water from a source of water, and which further supplies a portion of the source of water to the two cycle marine engine to remove heat energy generated by the two cycle marine engine during operation, and wherein this heated water is returned, at least in part, to the base assembly, and wherein a portion of the withdrawn water is returned to the source of water, and wherein the base assembly delivers the portion of the source of water to the two cycle marine engine at a water pressure; an exhaust expansion chamber borne by the base assembly and disposed in fluid receiving relation relative to the heated water which is returned to the base assembly from the two cycle marine engine, and wherein the two cycle marine engine produces a heated exhaust during operation, and wherein the heated exhaust further increases the temperature of the heated water which is received in the exhaust expansion chamber; a first conduit coupling the exhaust expansion chamber and the base assembly in fluid flowing relation one relative to the other; a flow restrictor coupled in fluid flowing relation relative to the first conduit, and positioned downstream relative to the exhaust expansion chamber and upstream of the base assembly, and wherein the flow restrictor restricts the flow of heated water departing from the exhaust expansion chamber so as to increase the temperature of the heated water and further increases the water pressure experienced by the two cycle marine engine; a thermostat operably coupled with the flow restrictor and disposed in selective fluid metering relation along the conduit, and wherein the thermostat upon sensing a predetermined temperature of the heated water opens to cause the heated water to by pass the flow restrictor; and a heater coupled in fluid flowing relation along the conduit and positioned downstream of the thermostat and flow restrictor and upstream from the base assembly, and wherein the heater receives the heated water traveling along the conduit and radiates the heat energy provided by the heated water to the ambient environment.

Yet further, the method for delivering heat energy from a water cooled two cycle marine engine, further includes providing a two cycle marine engine which produces a source of heated water having a water pressure; providing an exhaust expansion chamber which is operably coupled to the two cycle marine engine and which receives the source of heated water; providing a heater which is coupled in fluid flowing relation relative to the exhaust expansion chamber and which receives the heated water; and delaying the delivery of the heated water from the exhaust expansion chamber to the heater to increase the temperature of the heated water.

Moreover, the method for delivering heat energy from a water cooled two cycle marine engine further includes providing a water cooled two cycle marine engine; providing an exhaust expansion chamber and which is operably coupled to the two cycle marine engine; providing a continuous source of water under pressure to the two cycle marine engine to remove heat energy generated by the two cycle marine engine during operation, and wherein the source of water is heated; delivering the water which has been previous heated by the two cycle marine engine to the exhaust expansion chamber; providing a heater for receiving the heated water which has been delivered to the exhaust expansion chamber; coupling the heater in fluid flowing relation relative to the exhaust expansion chamber; metering the heated water from the exhaust expansion chamber to the heater so as to increase the temperature of the water; and maintaining the pressure of the continuous source of water delivered to the two cycle marine engine at or below a water pressure which does not impair the operation of the two cycle marine engine.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
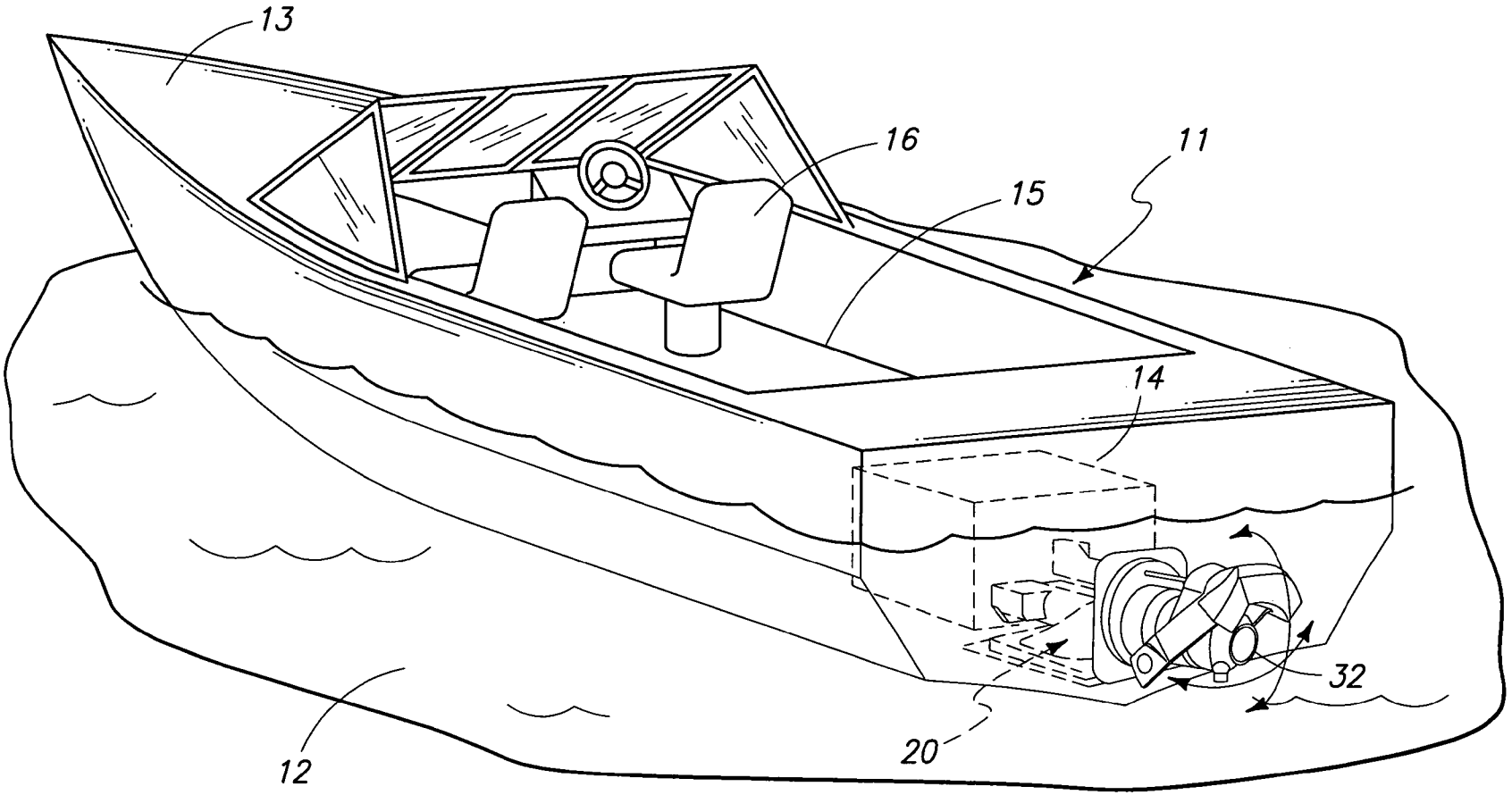
FIG 1 PRIOR ART
FIG. 1 is a fragmentary environmental view of a prior art water jet propulsion system installed on a traditional watercraft.
Figure 2:
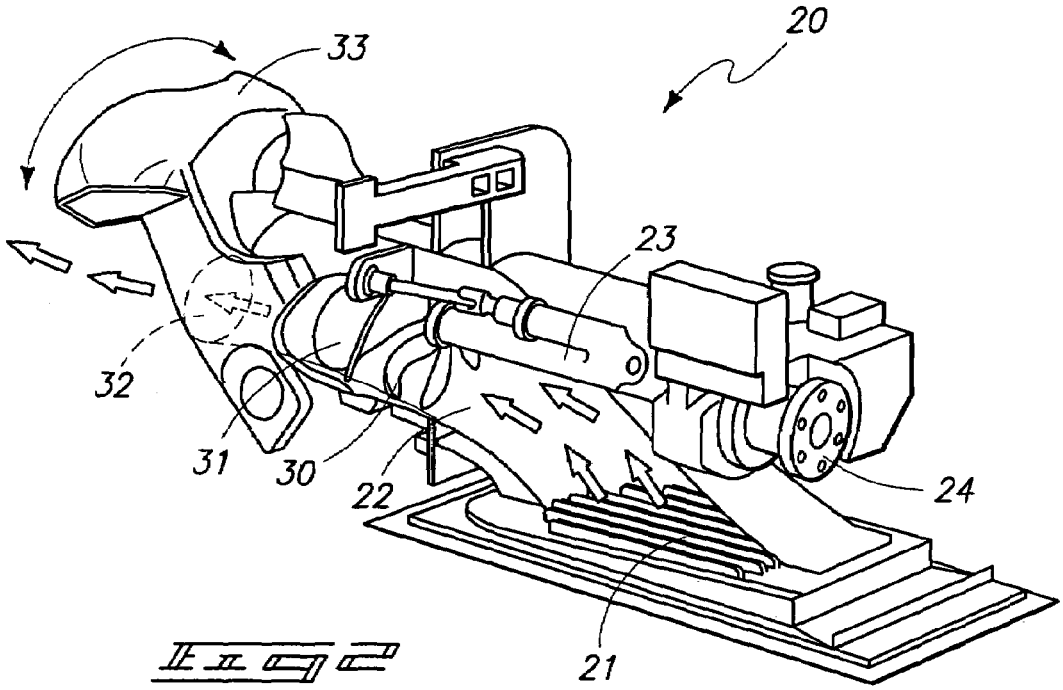
Fig 2 PRIOR ART
FIG. 2 is a fragmentary, perspective, side elevation view of a prior art water jet propulsion system with some surfaces removed to show the structure thereunder.
Figure 3:
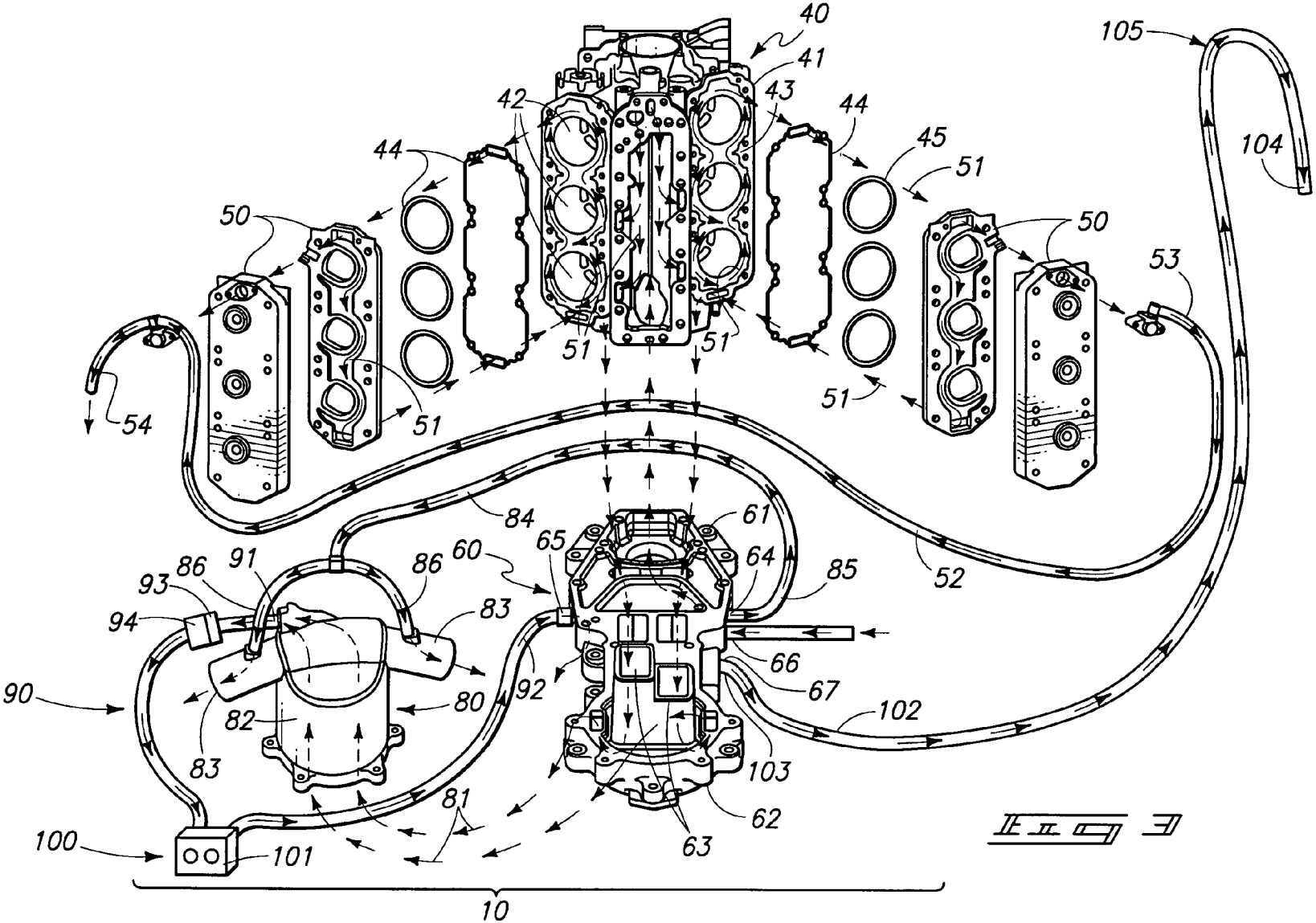
FIG. 3 is a greatly simplified, fragmentary, exploded view of a two cycle marine motor and the heater of the present invention.

The present invention is best understood by the exploded, perspective view as seen in FIG. 3. Referring now to FIG. 1, however, the invention 10 finds usefulness when mounted on a watercraft 11 of traditional design. The watercraft 11 rests on a body of water 12, and is defined by a forward or bow portion 13, and a rearward, or stern region which is defined by a transom 14. The watercraft 11 has a passenger compartment 15 and further has an operators' position 16. Referring now to FIG. 2, a prior art water jet propulsion system is shown in a fragmentary, perspective view with some supporting surfaces removed to illustrate the structure thereunder. The water jet propulsion system 20 includes a water intake 21 which is positioned in fluid communication with the body of water 12. This same water intake is coupled in fluid flowing relation relative to a fluid passageway 22 which extends from the water intake 21 through the transom 14 of the watercraft 11. The water jet propulsion system 20 has a drive shaft 23 which has a distal end, and which has a drive coupling 24 affixed thereon. The drive coupling 24 is coupled in force receiving relation relative to a two cycle marine motor which will be described in greater detail hereinafter and which is best seen by reference to FIG. 3. As seen in FIG. 2, an impeller 30 is affixed at a predetermined location along the drive shaft 23. Still further, and positioned aft of the impeller 30 is a stator 31. The impeller 30, when rotated, is operable to create a stream of water which is propelled down the fluid passageway 22 where it exits the jet nozzle 32. This high velocity stream of water then causes the watercraft 11 to move forwardly. The jet nozzle may be directed along an arcuately path of travel as seen in FIG. 1 in order to turn the boat in a port or starboard direction. Still further, in order to render the watercraft 11 moveable in a stern direction, a stern deflector 33 is provided and which is lowered into the high velocity water stream leaving the jet nozzle 32. After this high velocity water stream leaves the jet nozzle, it strikes the stern deflector thereby directing the high pressure generally water forwardly and downwardly thereby causing the watercraft to be propelled in a stern direction.

Referring now to FIG. 3, the present invention 10 is shown in this exploded perspective view where it is employed successfully in combination with a two cycle marine engine 40 of traditional design. The two cycle marine engine 40 as seen in FIG. 3 is a six cylinder marine engine. The marine engine has an engine block 41 which has a plurality of cylinders generally indicated by the numeral 42 and which are formed in a cylinder head 43. As seen, a gasket 44 fits in substantially fluid impeding relation there-about the respective cylinders 42. Traditional and well known seals are provided, and related cylinder covers are positioned in covering relation the top of the respective plurality of cylinders 42. As indicated by the many arrows shown in FIG. 3, a fluid passageway, which generally indicated by the numeral 51 traverses throughout the engine block 41 in order to provide a course of travel for a source of water which is directly withdrawn from the body of water 12 upon which the watercraft rests. This source of water is circulated throughout the two cycle marine engine 40 to absorb and then remove the heat energy that is generated by same when the engine 40 is rendered operational. This water becomes heated as a result of this circulation. As seen in FIG. 3, a fluid conduit 52 is provided and which couples the respective cylinder covers 50 in fluid flowing relation. The fluid conduit 52 has a first end 53 and an opposite second end 54. As seen in FIG. 3, the second end 54 is operable to discharge water to the ambient environment. As should be understood, the marine engine when rendered operational, is drivingly coupled to a prior art water jet propulsion system 20 such as seen in FIG. 2 in order to provide propulsion for the watercraft 11.

As seen in FIG. 3, a base assembly 60 is drivingly coupled to the two cycle marine engine 40. The base assembly has a first end 61 which is affixed to the engine block 41, and a second end 62 which is disposed in fluid flowing relation relative to the body of water 12. The base assembly 60, when energized by the engine 60, facilitates the withdrawal of a source of water from the body of water 12, and supply that same water, under pressure, to the water cooled two cycle marine engine 40 in order to remove the heat generated by the operation of the same engine. During the operation of the marine engine, heated exhaust is produced. The heated exhaust departs from the engine block 41 and passes into the base assembly 60 and exits same by way of a pair of exhaust ports which are generally indicated by the numeral 63. Still further, the base assembly 60 includes first, second, third and fourth fluid ports 64, 65, 66 and 67, respectively, and which are coupled in fluid flowing relation relative thereto. The operation of the respective fluid ports will be discussed in greater detail in the paragraphs which follow.

Referring still to FIG. 3, an exhaust expansion chamber 80 is operably coupled to the two cycle marine engine 40, and more specifically is mounted directly on the base assembly 60. The exhaust expansion chamber is operable to receive the heated exhaust 81 which is generated by the operation of the two cycle marine engine and direct the heated exhaust into the ambient environment. As seen in FIG. 3, the exhaust expansion chamber 80 has a main body 82 which is mounted on the base assembly 60. Still further, a pair of exhaust tubes 83 extend outwardly from the exhaust expansion chamber 80 such that the heated exhaust 81 may be exhausted to the ambient environment. As should be understood, the heated exhaust 81 imparts heat energy to the exhaust tubes 83. In view of this condition, a fluid conduit 84 is provided and which is coupled in fluid flowing relation therebetween the first fluid port 64, and the respective exhaust tubes 83. As seen, the fluid conduit 84 has a first end 85 which is coupled to the base assembly 60, and an opposite second end which is connected in fluid flowing relation with respect to the pair of exhaust tubes 83. As will be understood, the base assembly facilitates the withdrawal of water from the body of water 12, and further delivers a portion of the water into the exhaust tubes in order to cool or reduce the temperature of same. As should be understood, water which has been previously withdrawn from the source of water 12 by the base assembly 60 and which has been provided to the marine engine 40, leaves the marine engine in a heated state and is delivered back into the base assembly 60. As should be understood, this previously heated water is received in the exhaust expansion chamber at a temperature of about 60° F. to about 80° F. Once received in the exhaust expansion chamber 80, this previously heated water is exposed to heat energy imparted by the heated exhaust 81. In this arrangement, the heated exhaust 81 is operable to impart still further heat energy to the heated water thereby elevating the temperature of same such that the heated water leaves the exhaust expansion chamber at a temperature of about 160° F. to about 195° F.

Referring still to FIG. 3, it will be seen that a conduit 90 is provided and which couples the exhaust expansion chamber 80 in fluid flowing relation relative to the base assembly 60. This conduit 90 as seen in FIG. 3, has a first end 91 which is coupled in fluid flowing relation relative to the exhaust expansion chamber 80, and a second end 92 which is coupled in fluid flowing relation relative to the fluid port 65. Positioned downstream relative to the first end 91 is a flow restrictor which is generally indicated by the numeral 93. The flow restrictor 93 is coupled in fluid flowing relation relative to the conduit 90 and is further positioned upstream of the base assembly 60. The flow restrictor 93 restricts the flow of heated water departing from the exhaust expansion chamber 80 so as to increase the temperature of the heated water to about 160° F. to about 195° F. The flow restrictor has a diametral dimension of about 0.135 to about 0.145 inches. Still further, the flow restrictor increases the water pressure experienced by the two cycle marine engine 40. Referring still to FIG. 3, a thermostat 94 is made integral with the flow restrictor. The flow restrictor and thermostat are disposed in selective fluid metering relation along the conduit 90. The thermostat 94 is operable, upon sensing a predetermined temperature of the heated water to open, and thus cause the heated water to bypass the flow restrictor 93 and pass therealong the conduit 90 to the second or distal end 92.

Figure 4:
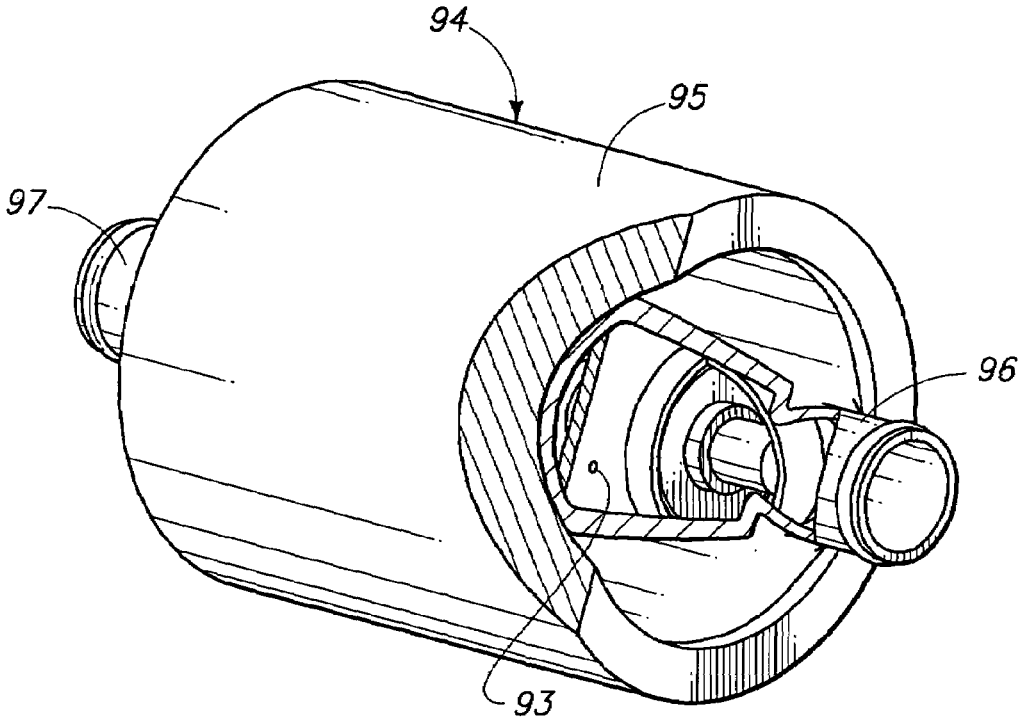
FIG. 4 is a perspective view of a thermostat with some surfaces removed to show the structure thereunder.

As seen in FIG. 4, the thermostat 94 has a main body 95 with a first end 96 and an opposite second end 97 which are both coupled in fluid flowing relation relative to the conduit 90. Positioned downstream of the flow restrictor 93, and upstream of the base assembly 60, is a heater which is generally indicated by the numeral 100. The heater may have a number of elements including a fan and other controls, not shown. The heater is operable to receive the heated water traveling therealong the conduit 90 and to radiate the heat from the water to the passenger compartment 15 in order to provide comfort to the passengers during inclement weather, or ambient air temperatures. After radiating heat to the ambient environment, the previously heated water would exit the heater 100 and travel to the distal or second end 92 of the conduit 90 and return to the base assembly 60 where it would then be exhausted back to the body or source of water 12. As seen in FIG. 3, a second conduit 102 is provided and which is coupled in fluid flowing relation relative to the fourth fluid port 67. The conduit 102 has a first end 103 which is coupled in fluid receiving relation relative to the base assembly, and an opposite second or distal end 104 which exhausts a portion of the heated water previously received in the base assembly back to the body of water 12. As seen in FIG. 3, the conduit 102 has a portion which is generally indicated by the numeral 105, and which is located intermediate the opposite first and second ends thereof, and which is positioned elevationally higher than the two cycle marine motor 40.

This physical relationship is required in order to provide for effective circulation of the source of water throughout the engine block 41 of the marine engine 40. Still further, it should be understood that the second conduit is operable to deliver a portion of the water which has been previously withdrawn from the source of water 12, and return it back to the source of water to facilitate a reduction of water pressure experienced by the two cycle marine engine. As should be understood, the flow restrictor 93 has the propensity for increasing the water pressure experienced by the marine engine 40. Consequently, the second conduit 102 ensures that the marine engine 40 operates efficiently and experiences no damage by being exposed to elevationally increased water pressure occasioned by the flow restrictor 93.

In the arrangement as shown in FIG. 3, the flow restrictor 93 includes an aperture which has a diametral dimension of about 0.135 inches to about 0.145 inches. Still further, the conduit 90 has an inside diametral dimension of about 0.68 inches to about 0.80 inches. In the arrangement as shown, and as discussed above, the heated water leaves the exhaust expansion chamber 80 at a temperature of about 160° F. to about 195° F. Still further, the thermostat is rendered operable to open thereby causing the heated water to bypass the flow resistor 93 when the temperature of heated the water is greater than about 195° F. This thermostat also operates as a safety device. In this regard, if the flow restrictor 93 becomes plugged or otherwise rendered inoperable, heated water may bypass same by means of the thermostat in order to prevent damage to the engine as might be occasioned by an exposure to increased engine block water pressure.

OPERATION

The operation of the described embodiment of the present invention is believed to be readily apparent and is briefly summarized at this point.

Referring now to the drawings, a heater 100 for a water cooled two cycle marine engine 40 is shown, and which includes an exhaust expansion chamber 80 which is operably coupled with a two cycle marine engine 40, and wherein the two cycle marine engine produces a source of heated water. Still further, a heater 100 is coupled in fluid flowing relation relative to the exhaust expansion chamber 80, and which receives the source of heated water; and a flow restrictor 93 is provided and which is coupled in fluid flowing relation relative to both the heater and the exhaust expansion chamber 80, and which delays the delivery of the heated water from the exhaust expansion chamber to the heater 100 to increase the temperature of the heated water.

More specifically, the present invention 10 which relates to a heater for a water cooled two cycle marine engine 40 includes an exhaust expansion chamber 80 which is operably coupled with a marine engine 40, and which receives water which has been previously heated by the operation of a marine engine. A heater 100 is provided, for receiving the heated water which has been previously delivered to the exhaust expansion chamber 80, and which radiates heat energy derived from the heated water to the ambient environment. A conduit 90 couples the exhaust expansion chamber 80 and the heater 100 in fluid flowing relation one relative to the other. Still further, a flow restrictor 93 is provided and is mounted in fluid metering relation along the conduit 90 and between the heater 100 and the exhaust expansion chamber 80. The fluid restrictor 93 increases the temperature of the water which has been delivered previously to the exhaust expansion chamber 80. The present invention further includes a thermostat 94 which is made integral with the flow restrictor 93 and wherein the thermostat opens to allow heated water to bypass the flow restrictor when the heated water has a temperature greater than about 195° F.

In the arrangement as shown, a heater 100 for a water cooled two cycle marine engine 40 includes a base assembly 60 which is coupled to a water cooled two cycle marine engine 40, and which facilitates the withdrawal of water from a source of water 12, and further supplies a portion of the source of water to the two cycle marine engine 40 to remove heat energy generated by the two cycle marine engine during operation. The heated water is returned, at least in part, to the base assembly 60. A portion of the withdrawn water 12 is returned to the source of water. As described earlier, the base assembly 60 delivers the portion of the source of water to the two cycle marine engine at a water pressure. An exhaust expansion chamber 80 is provided, and which is borne by the base assembly and which further is disposed in fluid receiving relation relative to the heated water which is returned to the base assembly 60 from the two cycle marine engine 40. The two cycle marine engine 40 produces a heated exhaust 81 during operation, and the heated exhaust 81 further increases the temperature of the heated water which is received in the exhaust expansion chamber 80. A first conduit 90 couples the exhaust expansion chamber 80, and the base assembly 60 in fluid flowing relation one relative to the other. A flow restrictor 93 is provided and coupled in fluid flowing relation relative to this first conduit 90, and positioned downstream relative to the exhaust expansion chamber 80, and upstream of the base assembly 60. The flow restrictor 93 restricts the flow of heated water departing from the exhaust expansion chamber 60 so as to increase the temperature of the heated water and further increases the water pressure experienced by the two cycle marine engine 40. A thermostat 94 is operably coupled with the flow restrictor 92, and disposed in selective fluid metering relation along the conduit 90. The thermostat 94, upon sensing a predetermined temperature of the heated water, opens to cause the heated water to bypass the flow restrictor 93. Still further, a heater 100 is coupled in fluid flowing relation along the conduit 90 and positioned downstream of the thermostat 94, and flow restrictor 93, and upstream from the base assembly 60. The heater 100 receives the heated water traveling along the conduit 90 and radiates the heat energy provided by the heated water to the ambient environment. A second conduit 102 is provided, and which couples the base assembly 60 in fluid flowing relation relative to the source of water 12. The second conduit is operable to deliver a portion of the water which has been previously withdrawn from the source of water 12, and return it back to the source of water to facilitate a reduction of the water pressure experienced by the block 41 of the two cycle marine engine 40. The conduit 102 has a first, intake end 103, which is coupled in fluid flowing relation relative to the base assembly 60, and a second, distal discharge end 104. Still further, a portion of the second conduit 105 is located intermediate the first and second ends thereof and is positioned elevationally higher than two cycle marine engine 40.

The present invention also includes a methodology for delivering heat energy from a water cooled two cycle marine engine 40. In its broadest aspects, the methodology includes the steps of providing a two cycle marine engine 40 which produces a source of heated water having a water pressure; and further providing an exhaust expansion chamber 80 which is operably coupled to the two cycle marine engine 40 and which receives the source of heated water. Still further, the methodology of the present invention includes the steps of providing a heater 100 which is coupled in fluid flowing relation relative to the exhaust expansion chamber 80, and which receives the heated water; and further delaying the delivery of the heated water from the exhaust expansion chamber to the heater 100 to increase the temperature of the heated water. In the methodology of the present invention the method further includes a step of maintaining the water pressure of the heater water at a level so as to not damage the two cycle marine engine 40. In addition to the foregoing, the methodology of the present invention includes a step of providing a base assembly 60, and operably coupling the base assembly 60 to the two cycle marine engine 40, and the exhaust expansion chamber 80. In the methodology as described, the method includes a step of coupling the heater 100 in fluid flowing relation relative to the base assembly 60; and withdrawing water from a continuous source 12, and supplying the continuous source of water to the two cycle marine engine 40 where the water cools the two cycle marine engine and is heated thereby. In the methodology as described, the method further includes a step of providing a flow restrictor 93, and coupling the flow restrictor in fluid metering relation relative to the heater 100. Still further, the method includes a step of providing a thermostat 94 and operably coupling the thermostat 94 to the flow restrictor, and wherein the thermostat is rendered operable when the heated water has a temperature of greater than about 195 degrees F.

In the methodology of the present invention a means is provided for delivering heat energy from a water cooled two cycle marine engine 40 which includes, among others, the steps of providing a water cooled two cycle marine engine 40; providing an exhaust expansion chamber 80, and which is operably coupled to the two cycle marine engine; providing a continuous source of water 12 to the two cycle marine engine to remove heat energy generated by the two cycle marine engine 40 during operation, and wherein the source of water is heated; delivering the source of water which has been previous heated by the two cycle marine engine 40 to the exhaust expansion chamber 80; providing a heater 100 for receiving the heated water which has been delivered to the exhaust expansion chamber 80; coupling the heater 100 in fluid flowing relation relative to the exhaust expansion chamber 80; metering the heated water from the exhaust expansion chamber 80, to the heater 100, so as to increase the temperature of the water; and maintaining the pressure of the continuous source of water delivered to the two cycle marine engine 40 at or below a water pressure which does not impair the operation of the two cycle marine engine.

Therefore it will be seen that the heater 10 and method for delivering heat energy from a water cooled two cycle marine engine 40 of the present invention provides many advantages over the prior art practices which have been utilized heretofore. In the arrangement as shown, the heater and methodology for delivering heat energy from the water cooled two cycle marine engine is simple, easy to install, is reliable, and provides many advantages for the operators of watercraft which are equipped with two cycle marine engines because watercraft equipped with the present invention may continue to operate in inclement weather and during periods of reduced temperatures.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A heater for a water cooled two cycle marine engine, comprising:

an exhaust expansion chamber operably coupled with a two cycle marine engine, and wherein the two cycle marine engine produces a source of heated water;

a heater coupled in fluid flowing relation relative to the exhaust expansion chamber, and which receives the source of heated water;

a flow restrictor coupled in fluid flowing relation relative to both the heater and the exhaust expansion chamber, and which delays the delivery of heated water from the exhaust expansion chamber to the heater to increase the temperature of the water;

a base assembly coupled to the two cycle marine engine and which withdraws water from a continuous source of water, and which delivers the continuous source of water to the two cycle marine engine to remove heat energy generated by the two cycle marine engine during operation, and wherein the heat energy generated by the two cycle marine engine during operation produces the source of heated water, and wherein the exhaust expansion chamber is operably coupled to the base assembly; and a conduit coupling the exhaust expansion chamber in fluid flowing relation relative to the base assembly, and wherein the heater is coupled in fluid flowing relation relative to the conduit, and is positioned downstream of the exhaust expansion chamber, and upstream of the base assembly, and wherein the flow restrictor is positioned in fluid metering relation therealong the conduit, and is positioned downstream of the base assembly and upstream relative to the heater.

2. A heater for a water cooled two cycle marine engine comprising:

an exhaust expansion chamber operably coupled with a two cycle marine engine, and wherein the two cycle marine engine produces a source of heated water;

a heater coupled in fluid flowing relation relative to the exhaust expansion chamber, and which receives the source of heated water;

a flow restrictor coupled in fluid flowing relation relative to both the heater and the exhaust expansion chamber, and which delays the delivery of the heated water from the exhaust expansion chamber to the heater to increase the temperature of the heated water; and a thermostat operably coupled to the flow restrictor, and which defines a fluid by pass which allows heated water to be diverted around the flow restrictor, and wherein the thermostat senses the temperature of the heated water passing through the flow restrictor, and wherein the thermostat upon sensing a given water temperature will divert the heated water into the fluid by pass.

3. A heater as claimed in claim 2, and wherein the flow restrictor is defined by an aperture which has a dimension of about 0.135 inches to about 0.145 inches.

4. A heater as claimed in claim 2, and wherein the source of heated water exits the heater and is delivered into the ambient environment.

5. A heater for a water cooled two cycle marine engine, comprising:

an exhaust expansion chamber which is operably coupled with a marine engine, and which receives water which has been previously heated by the operation of the marine engine;

a heater for receiving the heated water which has been previously delivered to the exhaust expansion chamber, and which further radiates heat energy derived from the heated water to the ambient environment;

a conduit coupling the exhaust expansion chamber and the heater in fluid flowing relation one relative to the other;

a flow restrictor mounted in fluid metering relation along the conduit and between the heater and the exhaust expansion chamber, and wherein the flow restrictor increases the temperature of the water which has been delivered to the exhaust expansion chamber; and a thermostat made integral with the flow restrictor, and wherein the thermostat opens to allow the heated water to by pass the flow restrictor when the heated water has a temperature of greater than about 195 degrees F.

6. A heater as claimed in claim 5, and further comprising:

a base assembly drivingly coupled to the two cycle marine engine, and wherein the exhaust expansion chamber is mounted on the base assembly, and wherein the conduit couples the base assembly and the exhaust expansion chamber together in fluid flowing relation.

7. A heater as claimed in claim 6, and wherein flow restrictor increases the water pressure experienced by the two cycle marine engine, and wherein the base assembly is coupled in fluid flowing relation relative to the ambient environment, and is operable to deliver a portion of the previously heated water to the ambient environment to reduce the water pressure experienced by the two cycle marine engine.

8. A heater as claimed in claim 5, and wherein the conduit has an inside diametral dimension of about 0.68 inches to about 0.80 inches, and wherein the flow restrictor is defined by an aperture which has diametral dimension of about 0.135 inches to about 0.145 inches.

9. A heater as claimed in claim 5, and wherein the source of water which has been previously heated by the two cycle marine engine is received in the exhaust expansion chamber at a temperature of about 60 degrees F. to about 80 degrees F., and wherein the heated water leaves the exhaust expansion chamber at a temperature of about 160 degrees F. to about 195 degrees F.

10. A heater as claimed in claim 9, and wherein the two cycle marine engine produces a heated exhaust, and wherein the heated exhaust further imparts heat energy to the source of heated water which is received from the two cycle marine engine to increase the temperature of heated water to a temperature of about 160 degrees F. to about 195 degrees F.

11. A heater for a water cooled two cycle marine engine comprising:

a base assembly drivingly coupled to a water cooled two cycle marine engine and which facilitates the withdrawal of water from a source of water, and which further supplies a portion of the source of water to the two cycle marine engine to remove heat energy generated by the two cycle marine engine during operation, and wherein the heated water is returned, at least in part, to the base assembly, and wherein a portion of the withdrawn water is returned to the source of water, and wherein the base assembly delivers the portion of the source of water to the two cycle marine engine at a water pressure;

an exhaust expansion chamber borne by the base assembly, and disposed in fluid receiving relation relative to the heated water which is returned to the base assembly from the two cycle marine engine, and wherein the two cycle marine engine produces a heated exhaust during operation, and wherein the heated exhaust further increases the temperature of the heated water which is received in the exhaust expansion chamber;

a first conduit coupling the exhaust expansion chamber and the base assembly in fluid flowing relation one relative to the other;

a flow restrictor coupled in fluid flowing relation relative to the first conduit, and positioned downstream relative to the exhaust expansion chamber and upstream of the base assembly, and wherein the flow restrictor restricts the flow of heated water departing from the exhaust expansion chamber so as to increase the temperature of the heated water and further increases the water pressure experienced by the two cycle marine engine;

a thermostat operably coupled with the flow restrictor and disposed in selective fluid metering relation along the conduit, and wherein the thermostat upon sensing a predetermined temperature of the heated water opens to cause the heated water to by pass the flow restrictor; and a heater coupled in fluid flowing relation along the conduit and positioned downstream of the thermostat and flow restrictor and upstream from the base assembly, and wherein the heater receives the heated water traveling along the conduit and radiates the heat energy provided by the heated water to the ambient environment.

12. A heater as claimed in claim 11, and further comprising:

a second conduit coupling the base assembly in fluid flowing relation relative to the source of water, and which is operable to deliver the portion of the water which has been previously withdrawn from the source of water, and return it back to the source of water to facilitate a reduction of the water pressure experienced by the two cycle marine engine, and wherein the conduit has a first, intake end which is coupled in fluid flowing relation relative to the base assembly, and a second, distal discharge end, and wherein a portion of the second conduit which is located intermediate the first and second ends thereof is positioned elevationally higher than two cycle marine engine.

13. A heater as claimed in claim 11, and wherein the flow restrictor is defined by an aperture which has a diametral dimension of about 0.135 inches to about 0.145 inches.

14. A heater as claimed in claim 11, and wherein the thermostat opens when the water traveling in the conduit has a temperature of greater than about 195 degrees F.

15. A method for delivering heat energy from a water cooled two cycle marine engine, comprising:

providing a two cycle marine engine which produces a source of heated water having a water pressure;

providing an exhaust expansion chamber which is operably coupled to the two cycle marine engine and which receives the source of heated water;

providing a heater which is coupled in fluid flowing relation relative to the exhaust expansion chamber and which receives the heated water;

providing a flow restrictor which is coupled in fluid flowing relation relative to the source of heated water delaying the delivery of the heated water from the exhaust expansion chamber to the heater by means of the flow restrictor to increase the temperature of the heated water; and providing a thermostat which is operably coupled with the flow restrictor and which diverts heated water around the flow restrictor when the heated water reaches a given temperature.

16. A method as claimed in claim 15, and further comprising:

maintaining the heated water at a water pressure so as to not damage the two cycle marine engine.

17. A method as claimed in claim 16, and further comprising:

providing a base assembly and operably coupling the base assembly to the two cycle marine engine and the exhaust expansion chamber;

coupling the heater in fluid flowing relation relative to the base assembly; and withdrawing water from a continuous source, and supplying the continuous source of water to the two cycle marine engine where the water cools the two cycle marine engine and is heated thereby.

* * * * *